United States Patent [19]

Avritt et al.

[11] 4,306,713

[45] Dec. 22, 1981

[54] DOCUMENT FEEDER

[75] Inventors: Michael D. Avritt, Boulder, Colo.; Richard A. Lamos, Delray Beach, Fla.

[73] Assignee: International Business Machines Corporation, Armonk, N.Y.

[21] Appl. No.: 143,954

[22] Filed: Apr. 25, 1980

[51] Int. Cl.[3] ..... B65H 3/06; B65H 3/52

[52] U.S. Cl. ..... 271/37; 271/122; 271/161; 271/165

[58] Field of Search ..... 271/122, 120, 119, 161, 271/37, 4, 10, 38, 35, 165, 166

[56] References Cited

U.S. PATENT DOCUMENTS

| | | | |
|---|---|---|---|
| 1,232,560 | 7/1917 | Juengst | 271/38 |
| 3,239,213 | 3/1966 | Griswold | 271/35 |
| 3,584,250 | 6/1971 | Bottani | 310/98 |
| 3,754,754 | 8/1973 | Peterson | 271/122 |
| 3,829,082 | 8/1974 | Hoyer | 271/4 |
| 4,034,976 | 7/1977 | Lundblad | 271/122 X |

FOREIGN PATENT DOCUMENTS

| | | | |
|---|---|---|---|
| 1564155 | 4/1980 | United Kingdom | 271/122 |

*Primary Examiner*—Bruce H. Stoner, Jr.

*Attorney, Agent, or Firm*—Joscelyn G. Cockburn; John H. Holcombe

[57] ABSTRACT

A document feed mechanism for feeding original documents to a copier imaging station. A bottom feed shingler wheel generates a shingled stack of original documents in a tray having a crowned shape, the tray crest being located forward of the shingler wheel. The shingled stack is supplied to a nip formed by an intermittently operated feed roll and a restraint roll which is rearwardly biased via a magnetic hysteresis slip clutch. The normal force on a sheet in the nip and the rearward bias force of the restraint roll are specifically controlled. The feed and restraint rolls intermittently supply single sheets to an imaging station feed mechanism.

6 Claims, 6 Drawing Figures

DOCUMENT FEEDER

CROSS-REFERENCE TO RELATED APPLICATION

U.S. patent application Ser. No. 63,622, filed Aug. 3, 1979, Clay et al, "Apparatus for Applying, Varying and Removing a Normal Force in a Shingler Wheel Type Document Feeder."

BACKGROUND OF THE INVENTION (1) Field of the Invention

This invention relates to document feeding and more particularly to the creation of a shingled stack of original documents and the feeding of single documents therefrom.

(2) Description of Prior Art

In order to free the user from giving constant attention to the copier, the increased automation of functions associated with copying is becoming more desirable. An example of such a function is the supply of original documents to the imaging station of the copier.

Automatic feeders are well known in the copier field, but primarily for the automatic feeding of copy sheets to the transfer station of the copier. Such feeders consistently feed the same size and same type of paper and thus can be highly specialized and adapted to the particular paper employed, and need not consider whether print would be marred.

The automatic feeding of original documents, however, should accommodate a wide range of papers varying, for example, in weight and texture. The feeder should conveniently separate each sheet from a stack and feed it singly without marking the sheet or marring the print. Prior feeding systems do not attain this goal and are limited in effectiveness to a specific narrow range of originals, or to a geometry (e.g., vertical sheets) that is difficult for a casual operator to use or understand.

The most convenient arrangement from the standpoint of the user is a bottom feed where the operator simply places a stack of originals in numerical order face down in a tray.

Bottom feeding, however, poses difficult problems for prior feeding arrangements. Friction pickers comprising a friction roll at the bottom of the tray often tend to pick many sheets at once, and beating or shingler wheels at the bottom of the tray combined with a nip pair of feed rollers tend to drag out sheets resting on top of the first sheet.

Examples of these arrangements included Hoyer, U.S. Pat. No. 3,861,671, "Liftable Bail Bar for Allowing Return of Multi-Ply Separated Sheets to Stack," showing vertical sheets fed by a friction roll to a feed roll and reversing roll; Hauser, U.S. Pat. No. 3,937,455, "Automatic Stack Feed," showing vertical sheet separated by a beating means to a feed roll and reversing roll; Sahley, U.S. Pat. No. Re. 27,976, "Document Feeder," showing a bottom friction feed for feeding sheets through a feed slot to a roller conveyor; Hunt, IBM Technical Disclosure Bulletin, Vol. 19, No. 10, March 1977, pp. 3628–3629, "Envelope Shingling Apparatus," shows a shingler wheel bottom feed of envelopes through a clump feed gate; Avritt, IBM Technical Disclosure Bulletin, Vol. 20, No. 2, July 1977, p. 496, "Bottom Sheet Paper Feed," shows a combination shingler wheel and belt feed; and Hunt et al, IBM Technical Disclosure Bulletin, Vol. 20, No. 2, July 1977, P. 497, "Sheet Shingler," shows a chain shingler.

SUMMARY OF THE INVENTION

An object of the present invention therefore is to provide a bottom feed system for a stack of original documents that is convenient to use and that reliably separates each sheet from the bottom of the stack for feeding forward singly.

Briefly, the invention comprises a tray for holding a stack of original documents, the tray generally inclined and having a crowned shape within the general incline, a bottom shingler located to the rear of the crest of the crowned portion of the tray to form a shingled stack of documents from a stack of documents, and a separator-restraint roller pair forward of the shingler and tray. The invention further comprises a restraint roll that is rearwardly biased via a magnetic hysteresis slip clutch.

DETAILED DESCRIPTION

Figure 1:
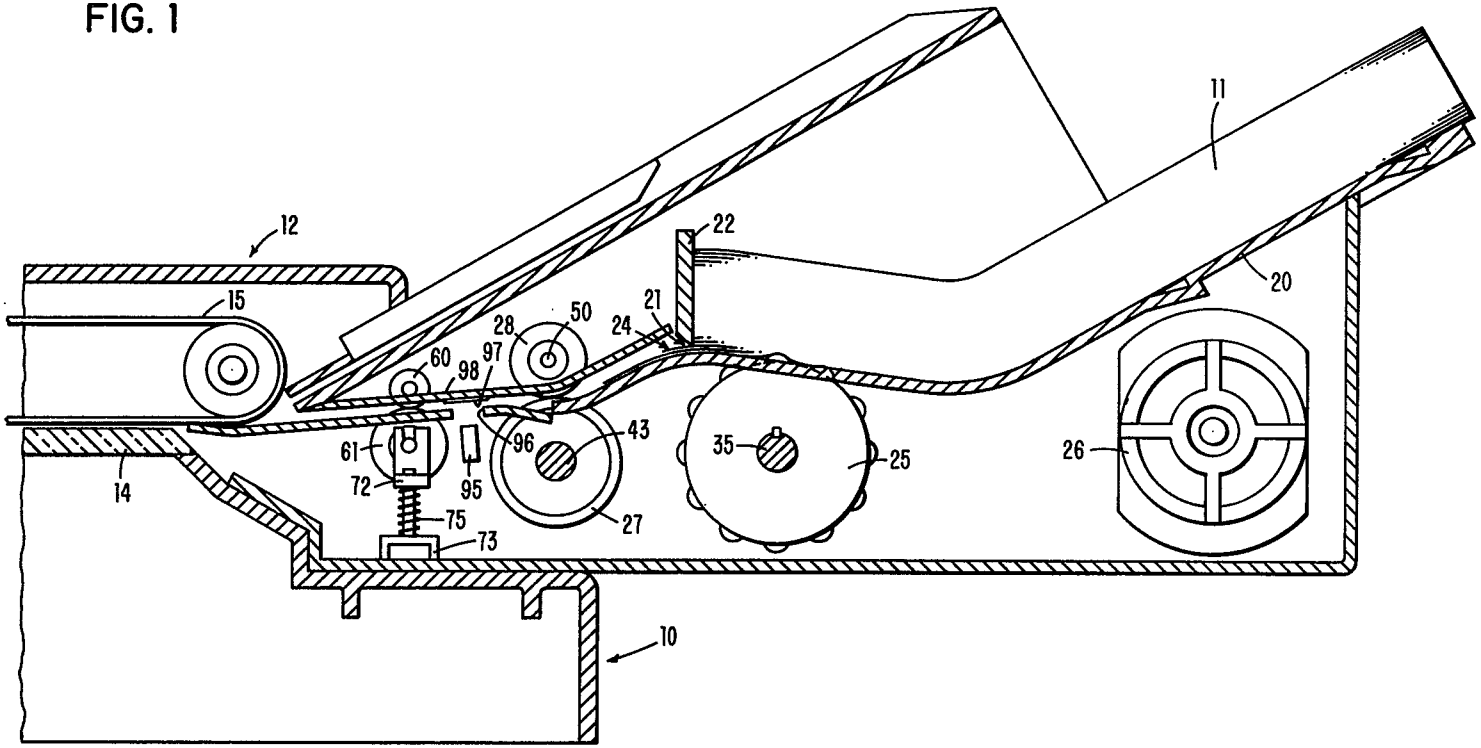
FIG. 1 gives a side cross-sectional view of the apparatus of the subject invention, including a stack of original documents.
Figure 2:
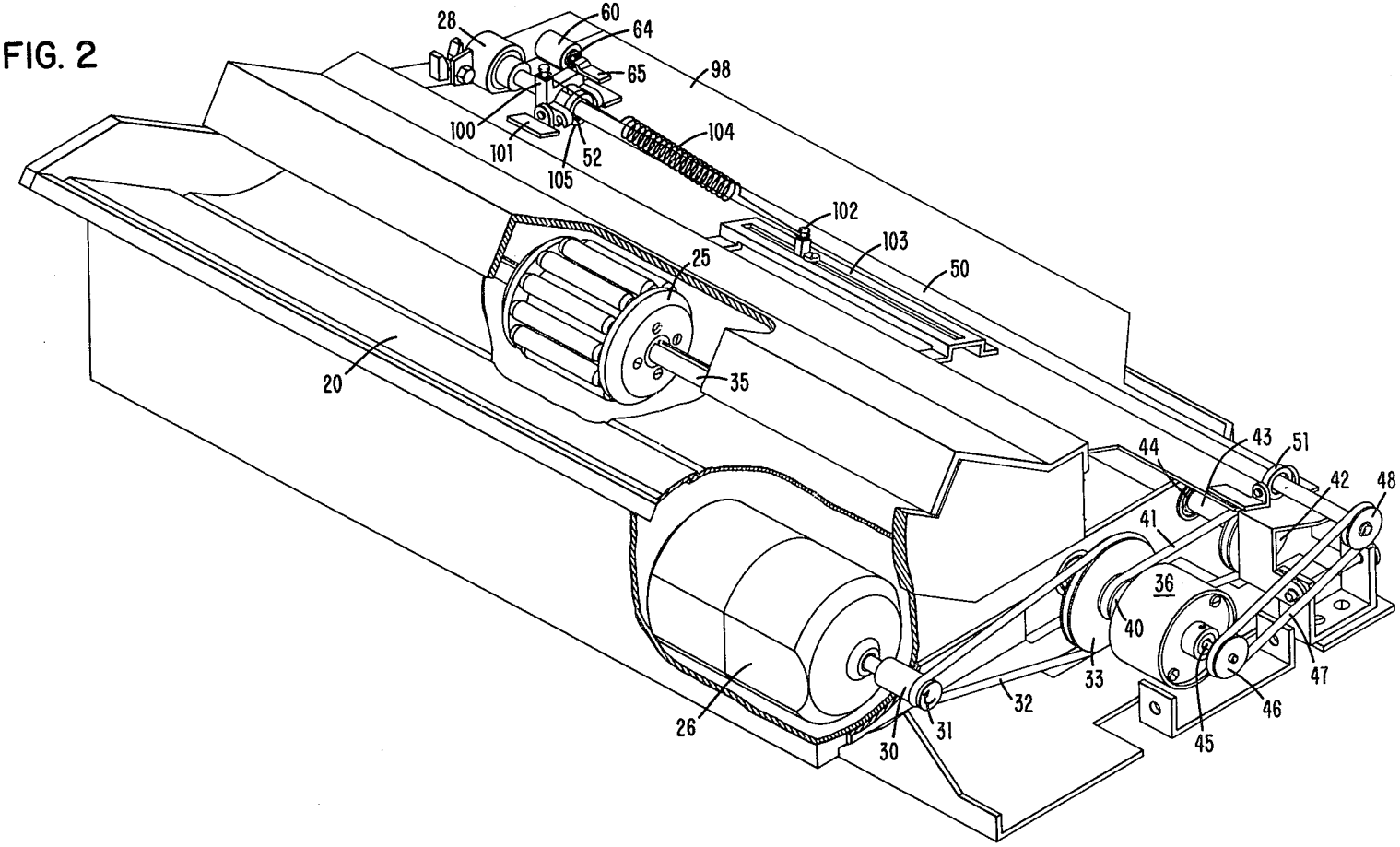
FIG. 2 is an isometric view of the apparatus of the subject invention, including a partial cutaway to illustrate the details thereof.

The document feeder of the present invention, as illustrated in FIGS. 1 and 2, is attached to a copier 10 to automatically supply original documents from a stack 11 singly to an imaging station 12 of the copier. The imaging station includes a document glass 14 and a drive belt 15 for positioning each original document suitably on the document glass 14.

The present invention includes a tray 20 which is generally inclined at a slight angle downwardly towards the imaging station 12, but which is provided with a crowned portion 21 which interrupts the general incline. A stacking edge or lip 22 forms a front alignment edge for a stack of sheets 11 which may be manually loaded into tray 20. Edge 22 is spaced from tray 20 to form a gate therebetween for the sheets to be shingled forward. The shingle 24 is formed by shingler wheel 25 which is driven by motor 26, as will be explained. The sheets from stack 11 are shingled forward to separator roll 27 and restraint roll 28.

Individual sheets may be advanced to the imaging station by separator roll 27 which feeds the bottom most sheet from the shingled stack to drive belt 15, while restraint roll 28 is urged in the reverse direction to prevent more than one sheet from being fed forward and also engages the sheet being fed forward and rolls therewith. In normal operation, the resultant motion of restraint roll 28 is oscillatory in nature, rotating forward one instant and in the reverse direction the next instant.

Referring to FIG. 2, the motor 26 in FIG. 1 rotates shaft 30 in the direction of arrow 31. Belt 32 is mounted on shaft 30 and on pulley 33. Belt 32 therefore imparts the rotary motion of shaft 30 to pulley 33. Pulley 33 is keyed to shaft 35 which is suitably mounted in bearings and attached to slip clutch 36 and to shingler wheel 25. Shingler wheel 25 may comprise any suitable shingling or combing wheel, but is preferably that described in U.S. Pat. No. 4,126,305 to Colglazier et al, "Combing Wheel," issued Nov. 21, 1978 (IBM).

The shaft 35 also has fixedly mounted thereon pulley 40 which drives belt 41 and which in turn drives pulley 42 mounted on shaft 43, which is mounted in suitable bearings, such as bearing 44. As shown in more detail in FIG. 3, shaft 43 is fixedly attached to and drives separator roll 27.

Magnetic hysteresis slip clutch 36 will be described in more detail hereinafter, but includes an output shaft 45 fixedly attached to pulley 46. Belt 47 is mounted on pulley 46 and on pulley 48. The output shaft urges pulley 46 in the closkwise direction, thereby urging belt 47 and pulley 48 also in the clockwise direction. Pulley 48 is fixedly attached to shaft 50, which is mounted for rotation in suitable bearings 51 and 52 and has fixedly mounted thereon restraint roll 28. The magnetic hysteresis slip clutch 36 thus urges restraint roll 28 in the clockwise direction, the counterclockwise direction in FIG. 1. Similarly, the motor urges shingler 25 and separator roll 27 in the clockwise direction, counterclockwise in FIG. 1.

Figure 3:
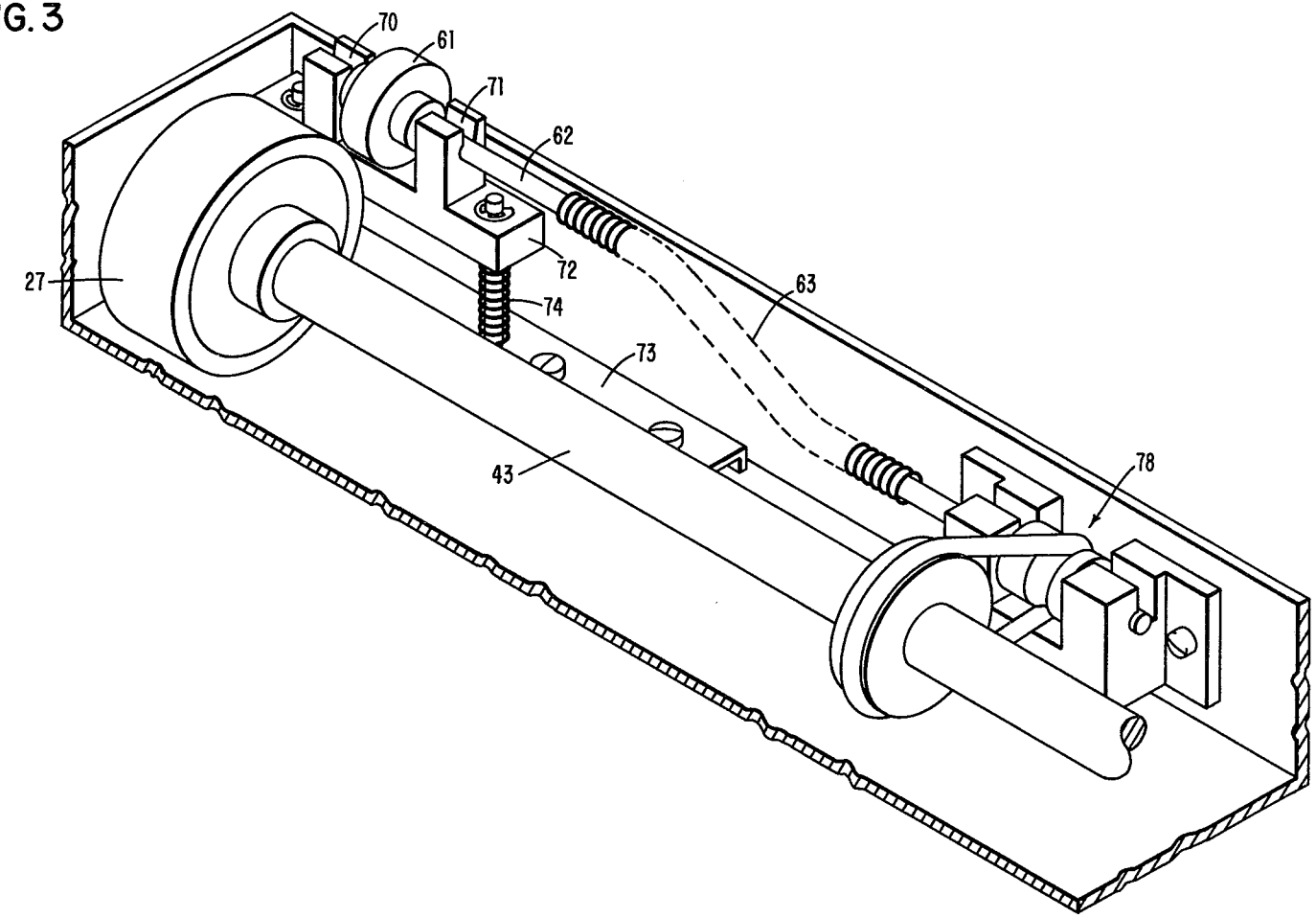
FIG. 3 is an isometric view of the detail of the separator roll of FIG. 1.

FIGS. 2 and 3 also illustrate, respectively, an idle roll 60, and a feed roll 61, the latter affixed to shaft 62. Idle roll 60 is mounted on internal bearing 64 for rotation on bracket 65. The shaft 62 for feed wheel 61 is mounted in slots 70 and 71 on bracket 72. The bracket is supported on frame member 73 by spring units 74 and 75 (see also FIG. 1), each of which includes both an alignment post and a compression spring. Shaft 62 is attached to flexible shaft 63 which is mounted to drive mechanism 78 and which obtains its rotary drive from shaft 43 of separator wheel 27.

Figure 4:
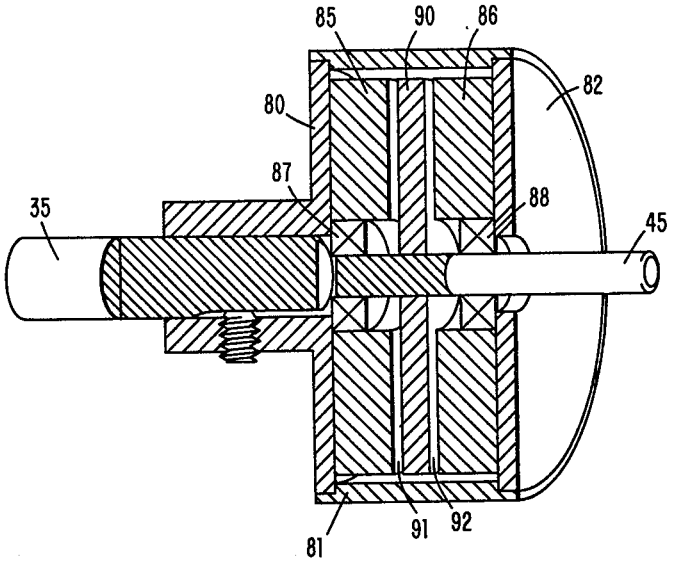
FIG. 4 is a cross-sectional view of the slip clutch of FIG. 2.
Figure 5:
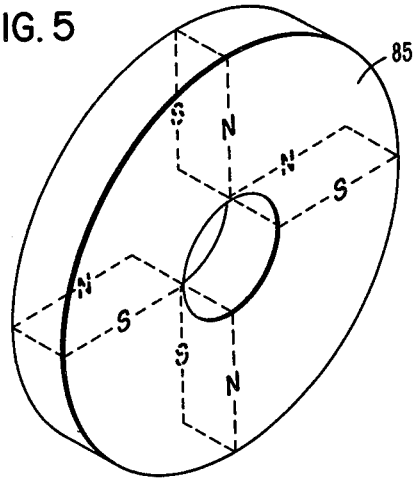
FIG. 5 is a diagrammatic illustration of the orientation of the magnetic material of the slip clutch of FIG. 5.

FIGS. 4 and 5 illustrate the details of magnetic hysteresis slip clutch 36 of FIG. 2. In FIG. 4, the input shaft 35 is rigidly attached to steel back plate 80. A rigid steel coupling 81 connects back plate 80 to another similar steel back plate 82. Identical 4-pole permanent magnets 85 and 86 are affixed, respectively, to steel back plates 80 and 82. Output shaft 45 is suspended in bearings 87 and 88 which are supported by the two permanent magnets. A hysteresis follower 90 is fixedly mounted on output shaft 45 and positioned to form two equal air gaps 91 and 92 between the follower and each of the permanent magnets. The magnetic pole orientation of permanent magnet 85 is illustrated in FIG. 5. Both magnets 85 and 86 are identical, their orientation within the slip clutch of FIG. 4 being in mirror image, so that the hysteresis follower 90 is exposed to the same polarities on both sides thereof.

The magnetic slip clutch of FIGS. 4 and 5 operates on the magnetic hysteresis principle. Specifically, the magnetic fields of the rotating permanent magnets 85 and 86 are used to drive the hysteresis follower 90 through its hysteresis loop, thereby imparting a torque to the output shaft 45 which is fixed to the hysteresis member 90. The energy dissipated per unit volume, in each cycle, is proportional to the area enclosed by the hysteresis loop. The resultant torque can be calculated by the following:

$$T = KW_hVP$$

Where:

T = Torque (in-lb)

K = Constant = 11.55 material dependent $W_h$ = Area of hysteresis loop (Joules/cm$^3$-cycle)

V = Volume of hysteresis member

P = Number of poles of magnet

Since the area of the hysteresis loop is dependent upon the flux density, and the flux density within hysteresis material is dependent upon the distance from the magnet, the torque output of the clutch can be adjusted by varying the air gaps 91 and 92 between the magnets and the hysteresis follower 90. The torque output can also be adjusted by misorienting the two magnets.

Figure 6:
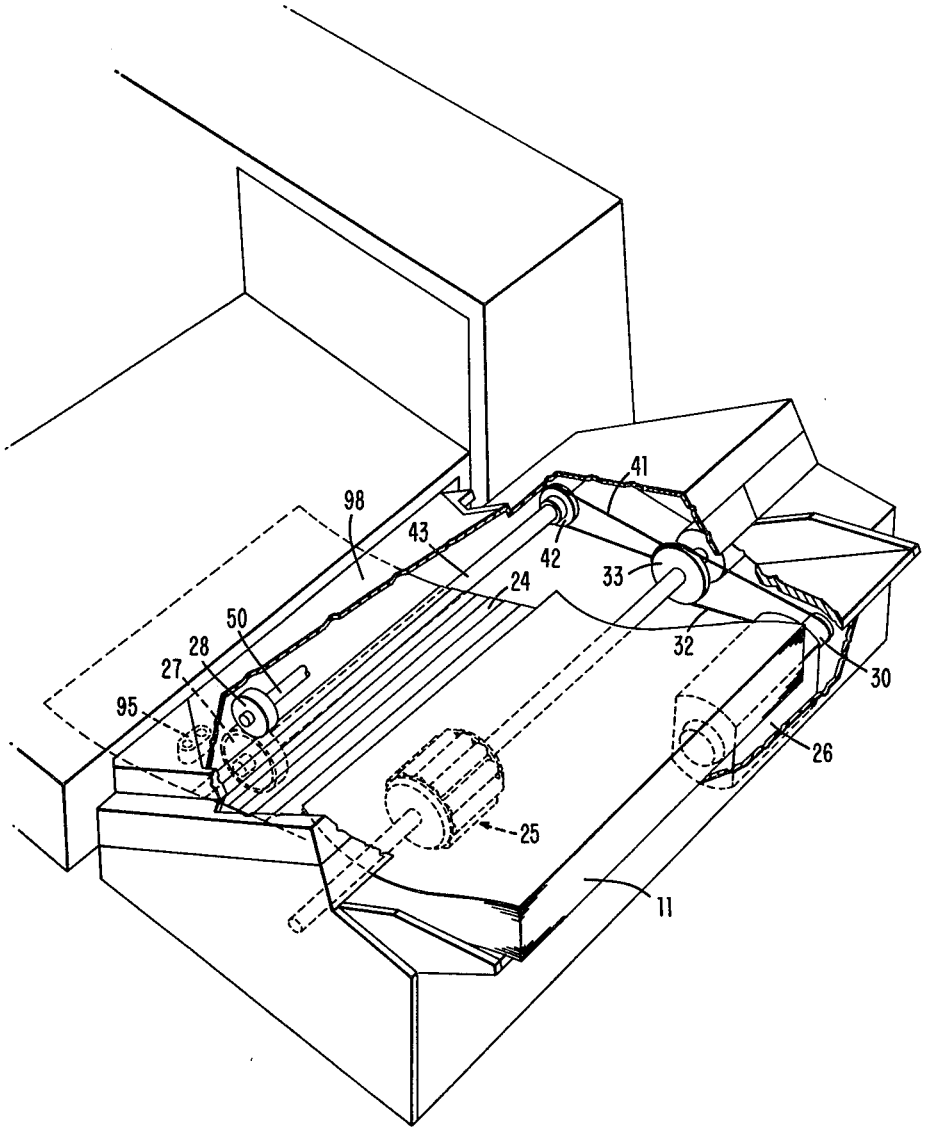
FIG. 6 is a schematic view shown in isometric of the shingled stack and stack of original documents of FIG. 1.

A sheet sensor 95 is provided as illustrated in FIGS. 1 and 6, comprising an L.E.D. (light emitting diode) light source and an adjacent photosensor, supported by a bracket (not shown) and directed through slot 96 at reflective surface 97 on plate 98. If no sheet is present between the slot and reflective surface, light emitted by the L.E.D. is reflected by surface 97 to the photosensor and is detected. If a sheet is present, the reflective surface 97 is blocked and insufficient light is reflected by the sheet to the photosensor to be detected. Thus, detection of light by the photosensor indicates that no sheet is present between the slot and reflective surface.

The operation of the above apparatus will be explained, with initial reference to FIGS. 1 and 6. Upon the apparatus being turned on for sheet feeding, sensor 95 is employed to indicate the presence or absence of a sheet. If the sensor detects the reflected light, indicating the absence of a sheet, power is supplied to motor 26. Motor 26, via the previously described belts, pulleys, and hysteresis slip clutch, simultaneously drives shingler 25 and separator roll 27 in the forward direction, and urges restraint roll 28 in the reverse direction. Assuming a shingle has not yet been formed, the rotation of shingler 25 in the counterclockwise direction in FIG. 1 gradually urges the sheets 11 adjacent the wheel forward, the sheet immediately adjacent the wheel the greatest amount, the next sheet less, etc. The motor 26 also rotates separator roll 27 in the counterclockwise direction, and the friction between separator roll 27 and restraint roll 28 is such that the frictional force overcomes the urging by slip clutch 36 such that restraint roll 28 is rotated by the separator roll in the clockwise direction in FIG. 1.

Once the shingle 24 is formed, the lowermost sheet reaches separator roll 27 and restraint roll 28. The function of the separator roll and restraint roll are to separate the lowermost single sheet from the shingled stack for feeding onto the document glass 12, while restraining subsequent sheets behind the separator-restraint station. Specifically, the torque at the separator shaft 43 supplies the forward driving force to the lowermost sheet being fed. The torque at the restraint shaft 50 delivered by the hysteresis clutch supplies the restraining force which keeps multiple sheet feeds from occurring.

The lowermost sheet will be fed by separator roll 27 until sensed by sensor 95. This indicates that the shingled stack 24 has been formed from the stack of sheets 11, and the sensor responds by turning off power to motor 26.

When the copier is ready for a sheet to be fed, it controls and turns on motor 26. The motor operates separator roll 27 which feeds the sheet forward to the nip formed by feed roll 61 and idle roll 60. The rolls engage the sheet, pulling it from separator roll 27 and feeding it to belt 15 for feeding and alignment thereby at imaging station 12 on document glass 14. Should a second or other sheet tend to go through the nip between separator roll 27 and restraint roll 28, the torque on restraint roll 28, together with the friction between restraint roll 28 and the second sheet overcomes the friction between the sheet being fed by separator roll 27 and that second sheet, so that restraint roll 28 rotates in the reverse direction moving the second sheet backwards out of the nip.

In practice, the restraint roll 28 is rotated in the forward direction by the sheet being fed by separator roll 27 and the second sheet of the shingled stack 80 moves slightly into the nip between restraint roll 28 and separator roll 27. Thereupon, restraint roll 28 moves the sheet backwards out of the nip. Thus, restraint roll 28 undergoes a very high frequency oscillation over a very small angular distance first in the forward direction, then in the reverse direction.

The separator-restraint station functions properly if the following governing inequalities are satisfied.

$$\frac{\tau_S}{r_S} > \frac{T}{r_R} + F_D > \mu_{R-P}N + F_D \quad (1)$$

$$\mu_{S-P}N > \frac{T}{r_R} + F_D > \mu_{R-P}N + F_D \quad (2)$$

$$\mu_{R-P}N > \frac{T}{r_R} + F_D > \mu_{P-P}N + F_D \quad (3)$$

Where:

$F_D$=drag force on sheet to be fed

N=normal force between separator and restraint rollers $r_R$=radius of restraint roller $r_S$=radius of separator roller T=torque at restraint shaft delivered by hysteresis clutch (back driving torque)

$\mu_{P-P}$=coefficient of friction paper to paper $\mu_{R-P}$=coefficient of friction restraint to paper $\mu_{S-P}$=coefficient of friction separator to paper $\tau_S$=torque at separator shaft As the trailing edge of the lowermost sheet being fed to imaging station 12 leaves the nip between restraint roll 28 and separator roll 27, the next adjacent sheet enters the nip. The roll 61 draws the first sheet forward and belt 15 feeds the sheet onto document glass 14, aligning it. Upon completion of the alignment and positioning of the sheet, the copier turns off motor 26. Should there be no, or only a small, gap between the sheets, sensor 95 will not continue applying power to motor 26. However, should the shingled stack 24 be incompletely formed, sensor 95 will indicate that no sheet is present, and will therefore continue to apply power to motor 26 to completely form the shingled stack 24 until the bottommost sheet reaches sensor 95.

Referring again to the restraint roll 28 and its operation by magnetic hysteresis slip clutch 36, during the time when a single sheet or no sheet is in the separator-restraint nip, the back driving torque of the hysteresis clutch 36 is overridden by the friction between the restraint roll 28 and separator roll 27 so that the restraint roller is driven in the direction of paper feed. The torque required in the magnetic hysteresis slip clutch 36 in order to force a second or more sheets backwards out of the separator-restraint nip, has been determined to be approximately 7.5 ounce-inch with a normal force at the nip of the restraint roll 28 and separator roll 27 on the sheet of approximately 2.25 pounds. As shown in FIG. 3, shaft 50 is mounted in bearing 52 which is supported by bracket 100 pivotally mounted on support member 101. The normal force may be adjusted by moving a sliding spring anchor 102 in the bracket 103, to thereby adjust the tension of a spring 104 and the force on bracket 100 and gimble 105 which supports bearing 52. Thus, slight differences in torque output from various clutches 36 may be compensated for by adjusting the normal force on restraint roll 28 to satisfy the previously described inequalities. The force of bracket 100 on gimble 105 acts through the spring 104 having a low spring rate so that small amounts of wear on the restraint roll 28 or separator roll 27 will not substantially effect operation of the system. Further, the air gaps in the magnetic hysteresis clutch 36 may be adjusted to adjust the torque on restraint roll 28 or the magnet alignment changed. For effective operation, restraint roll 28 and separator roll 27 employ silicon-rubber surfaces.

While the invention has been particularly shown and described with reference to the above preferred embodiments thereof, it will be understood by those skilled in the art that various changes in form and details may be made therein without departing from the spirit and scope of the invention.

What is claimed is:

1. A document feeding apparatus comprising: a downwardly inclined tray for supporting documents for feeding, said tray having a crowned shape within said incline;

shingling means protruding above said tray rearwardly of the crest of said crowned portion for forming a shingled stack of said supported documents;

separator roll means forward of the crest of said crowned portion for feeding the bottommost document of said shingled stack; and restraint roll means forward of the crest of said crowned portion biased for rotation in the rearward direction and forming a nip with said separator roll means.

2. The document feeding apparatus of claim 1 wherein:

said restraint roll means is additionally biased at a constant torque.

3. The document feeding apparatus of claim 1 wherein said restraint roll means comprises:

a roll forming a nip with said separator roll means; and magnetic hysteresis means for providing an urging torque to said roll for rotation thereof in the rearward direction.

4. The document feeding apparatus of claim 3 wherein said restraint roll means additionally comprises:

normal force means for generating a normal force between said roll and said separator roll means at said nip.

5. The document feeding apparatus of claim 4 wherein said restraint roll means is arranged to provide said normal force and said rearward urging torque in accordance with the following:

$$\frac{\tau_S}{r_S} > \frac{T}{r_R} + F_D > \mu_{R-P}N + F_D \quad (1)$$

-continued $$\mu_{S-P}N > \frac{T}{r_R} + F_D > \mu_{R-P}N + F_D \quad (2)$$

$$\mu_{R-P}N > \frac{T}{r_R} + F_D > \mu_{P-P}N + F_D \quad (3)$$

where:

$F_D$=drag force on document to be fed

N=said normal force between said separator roll means and said restraint roll $r_R$=radius of said restraint roll $r_S$=radius of said separator roll means T=torque at restraint roll delivered by said magnetic hysteresis means $\mu_{P-P}$=coefficient of friction between adjacent said documents $\mu_{R-P}$=coefficient of friction between said restraint roll and said document $\mu_{S-P}$=coefficient of friction between said separator roll means and said document $\tau_S$=torque at separator roll means.

6. The document feeding apparatus of claim 1 wherein:

said inclined tray for supporting documents for feeding is downwardly inclined, having a depression followed by said crowned shape such that said tray slopes upwardly from the base of said depression to the crest of said crowned shape; and said shingling means protrudes above the surface of said tray at said upwardly sloping portion thereof.

* * * * *